United States Patent [19]

Steinle et al.

[11] 4,020,624

[45] May 3, 1977

[54] PENDULUM CLOCK

[75] Inventors: Gerhart Steinle; Siegfried Rossmann, both of Schwenningen, Germany

[73] Assignee: Urgos Uhrenfabrik Schwenningen a.N. Haller, Jauch und Pabst, Schwenningen, Germany

[22] Filed: Mar. 31, 1975

[21] Appl. No.: 563,370

[30] Foreign Application Priority Data

Mar. 29, 1974 Germany ..... 2415189
Oct. 17, 1974 Germany ..... 2449435

[52] U.S. Cl. ..... 58/2; 58/123; 58/129

[51] Int. Cl.[2] ..... G04B 15/14; G04B 17/02

[58] Field of Search ..... 58/2, 123, 124, 129, 58/131–135

[56] References Cited

UNITED STATES PATENTS

| | | | |
|---|---|---|---|
| 291,432 | 1/1884 | Votti | 58/123 |
| 3,747,332 | 7/1973 | Marquis | 58/129 X |
| 3,874,324 | 4/1975 | Nofziger | 58/134 X |

*Primary Examiner*—Stanley J. Witkowski
*Attorney, Agent, or Firm*—Walter Becker

[57] ABSTRACT

A pendulum clock which has its pendulum connected to a carrier member by means of a pendulum extension that is connected to the upper end section of the pendulum and is fixedly or detachably connected to a pendulum spring. The pendulum extension extends into a keeper fork which latter has connected thereto a connecting member with a fork-shaped end the legs of which straddle the pendulum extension below the pendulum spring.

6 Claims, 6 Drawing Figures

PENDULUM CLOCK

The present invention relates to a pendulum clock with a pendulum which by means of a pendulum extension connected to the upper end section of said pendulum which extension engages a keeper fork and is fixedly or detachably connected to a pendulum spring, is connected on a carrier axle. The present invention, however, does not concern a pendulum clock with a customary drop-off control device between the keeper fork and the pendulum extension.

Heretofore, when mounting or suspending pendulum clocks of the above mentioned general type, it was necessary that for the uniformity of the movement of the pendulum clock an expert had to be employed for checking the same. With this checking operation it was first necessary to suspend the pendulum and then to test the movement of the pendulum. It in this connection it was found out that the movement of the pendulum was non-uniform, the pendulum had again to be removed, and a corresponding adjustment of the keeper fork had to be effected. Suspended clocks had to be taken off the wall for this purpose and had to be opened on their back side and then the keeper fork had to be centrally so adjusted that the pendulum during its leftward oscillations as well as during its rightward oscillations describes the same angle of oscillation. With this type of pendulum clocks, the necessary adjusting work had heretofore to be affected only by experts because otherwise the danger exists that during the setting of the keeper fork carried out by pressure upon the lower end of the pendulum extension or directly upon the pendulum could simultaneously damage the pendulum spring.

It is, therefore, an object of the present invention so to design the pendulum clock that it will be possible to adjust the movement of the pendulum clock in a simple manner while eliminating the danger of damaging the pendulum clock.

These and other objects and advantages of the invention will appear more clearly from the following specification in connection with the accompanying drawings, in which.

The pendulum clock according to the present invention is characterized primarily in that to the keeper fork there is connected a connecting member, the legs of which straddle the pendulum extension below the pendulum spring. In this way it is possible directly by a lateral deviation of the pendulum to set the proper movement of the pendulum. Thus, the setting of the movement can also be carried out by an unskilled person without the danger of the above mentioned damage to the pendulum spring. The connecting member engages in a fork-shaped manner from below the pendulum spring so that in case of too far a deviation of the pendulum extension or of the pendulum, no force which might bring about a bending of the pendulum spring can become effective simultaneously with the adjustment of the keeper fork upon the pendulum spring.

Figure 1:
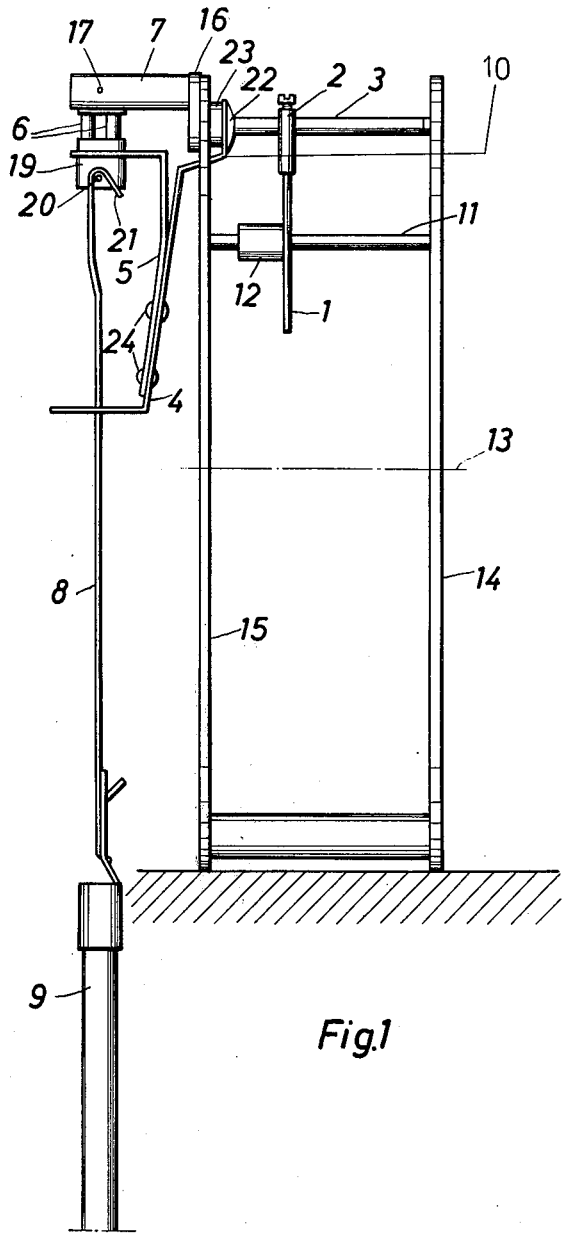
FIG. 1 shows the side view of the clock mechanism of the pendulum clock.
Figure 2:
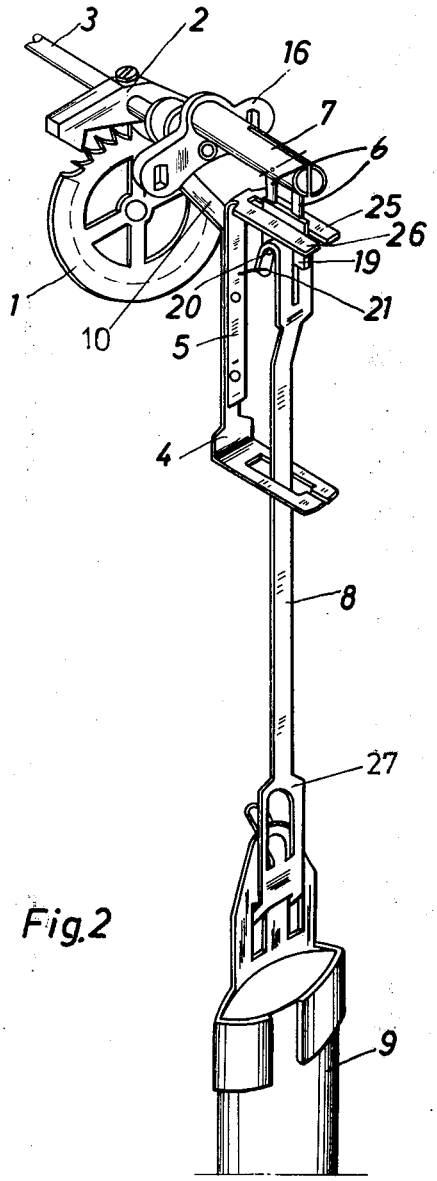
FIG. 2 is an isometric view of the clock parts of the pendulum clock according to the invention.
Figure 3:
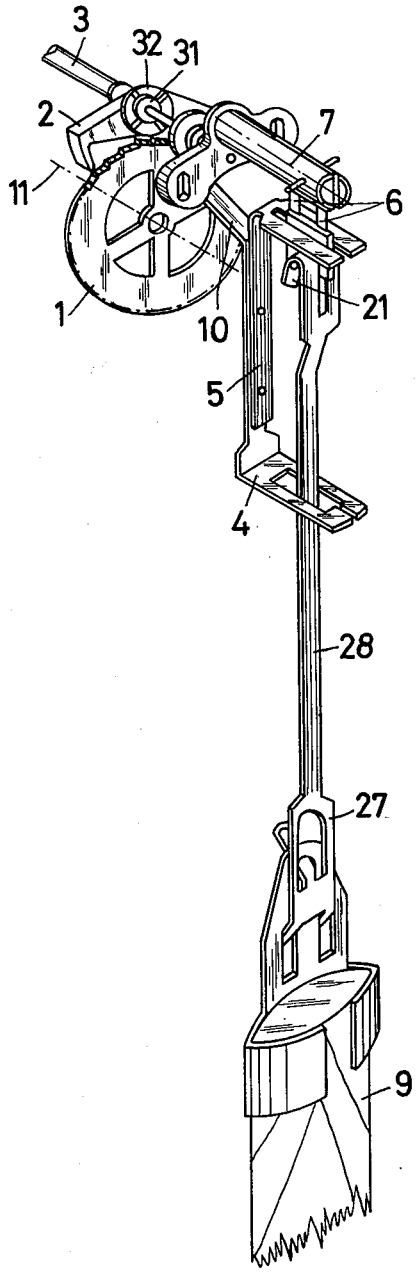
FIG. 3 illustrates an isometric view of the clock work elements of a second embodiment of a pendulum clock according to the invention.
Figure 4:
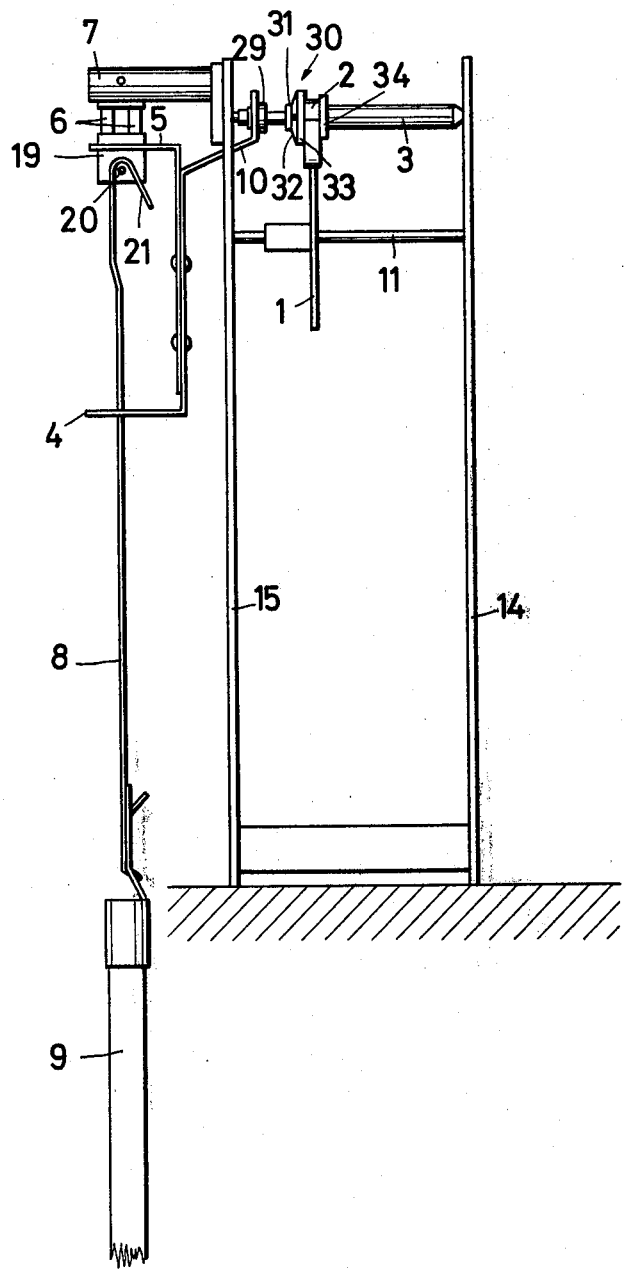
FIG. 4 is a side view of the clock work elements of the pendulum clock according to FIG. 3.

Referring now to the drawings in detail, and FIGS. 1 and 2 thereof in particular, a keeper 2 adapted to oscillate back and forth is mounted on a keeper shaft 3. The keeper 2 cooperates with a movement wheel 1 which is mounted on a movement shaft 11 and on its pinion 12 is driven by a non-illustrated gear. The drive may be effected either through the intervention of a sprocket wheel, not shown in the drawings, or by a weight or by another electrical or mechanical power storage means. At 13 of FIG. 1, the axis of a minute gear is indicated which, similar to the movement gear shaft 11 and the keeper shaft 3, is journaled in a front plate 14 and in a rear plate 15 of the clock work.

In the direct vicinity of the rear plate 15 there is provided a keeper bridge 16 having connected thereto a carrier shaft 7. By means of a screw indicated at 17 or by means of a pin, a pair of pendulum springs 6 is connected along the carrier axis by means of an upper spring holding plate. The said pendulum springs 6 are at their free end sections firmly connected by a second spring holding plate 19. The lower spring holding plate 19 carries a bearing pin 20 which projects to both sides and on which the pendulum extensions 8 punched out of a thin metal sheet may be suspended by means of their hook-shaped bent-off end sections 21. The pendulum 9 which may be of any desired design and oscillates back and forth and during the movement of the clock oscillates back and forth about the axis of the keeper shaft 3 engages the lower hook-shaped end section 27 of the pendulum extension 8.

For purposes of conveying the oscillation movement of the keeper 2 onto the pendulum 9 there is provided a keeper fork 4, the upper end section of which is kept under tension by means of a dish spring 22 against a counterbearing 23 connected to the keeper shaft 3 while a frictional connection between the keeper fork 4 and the keeper shaft 3 is effected, said keeper fork straddling in a manner known per se, the pendulum extension 8. The keeper fork 4 is connected to the keeper shaft 3 through the intervention of a bearing arm 10. In order to make sure that the pendulum clock can advantageously directly by lateral deviation of the pendulum be so adjusted that the pendulum 9 and the pendulum extension 8 on both sides can carry out uniformly great oscillations relative to the rest position of the pendulum, there is provided a connecting member 5 which is connected to a crank of the keeper fork 4 by means of two rivets 24. Preferably, however, the keeper fork 4 and the connecting member 5 form one single integral piece. The bent end section of the connecting member 5 has two legs 25 and 26 which extend parallel to each other. The two legs 25 and 26 straddle the lower spring holding plate 19 together with the pendulum springs 6 at slight lateral distance and assure that in response to too far a deviation of the pendulum extension 8 or of the pendulum 9, when the proper pendulum position has been set, no force which could bring about a bending of the pendulum spring 6 can simultaneously with the adjustment of the keeper fork 4 act upon the pendulum springs and damage same. In this connection, it is important that when correcting the position of the keeper fork, for instance, when laterally displacing the keeper fork, to the same extent as the keeper fork also the connecting member 5 is carried along. The connecting member 5 may be discarded when the keeper fork 4 is so designed that it engages, as customary, not only the central region of the pendulum extension 8, but additionally also engages in a fork-shaped manner the upper region of said pendulum extension. In view of the frictional connection generated by the dish spring 22 of the keeper fork 4 with the keeper shaft 3 it is possible that by lateral adjustment of the keeper fork 4 relative to the keeper shaft 3 a pendulum deviation equal toward all sides can be set without turning the keeper shaft 3. In this way, it will be possible in a simple manner, to obtain a precise movement of the pendulum clock for which movement it is decisive that the pendulum 9 points vertically downwardly to the center of the earth.

Figure 5:
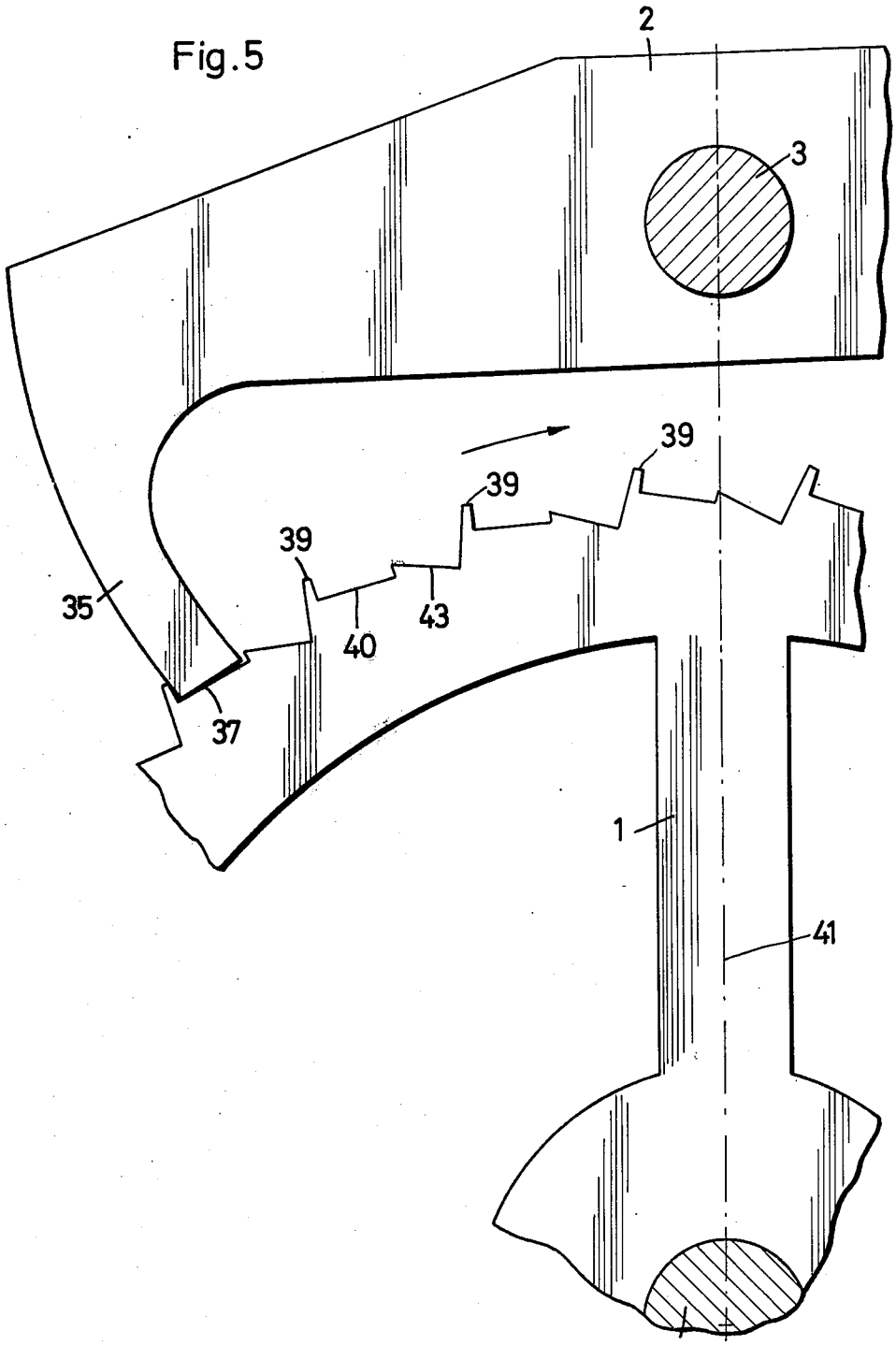
FIG. 5 shows on an enlarged scale the keeper of the pendulum clock according to FIG. 3 and shows the pertaining movement gear in its entry position.
Figure 6:
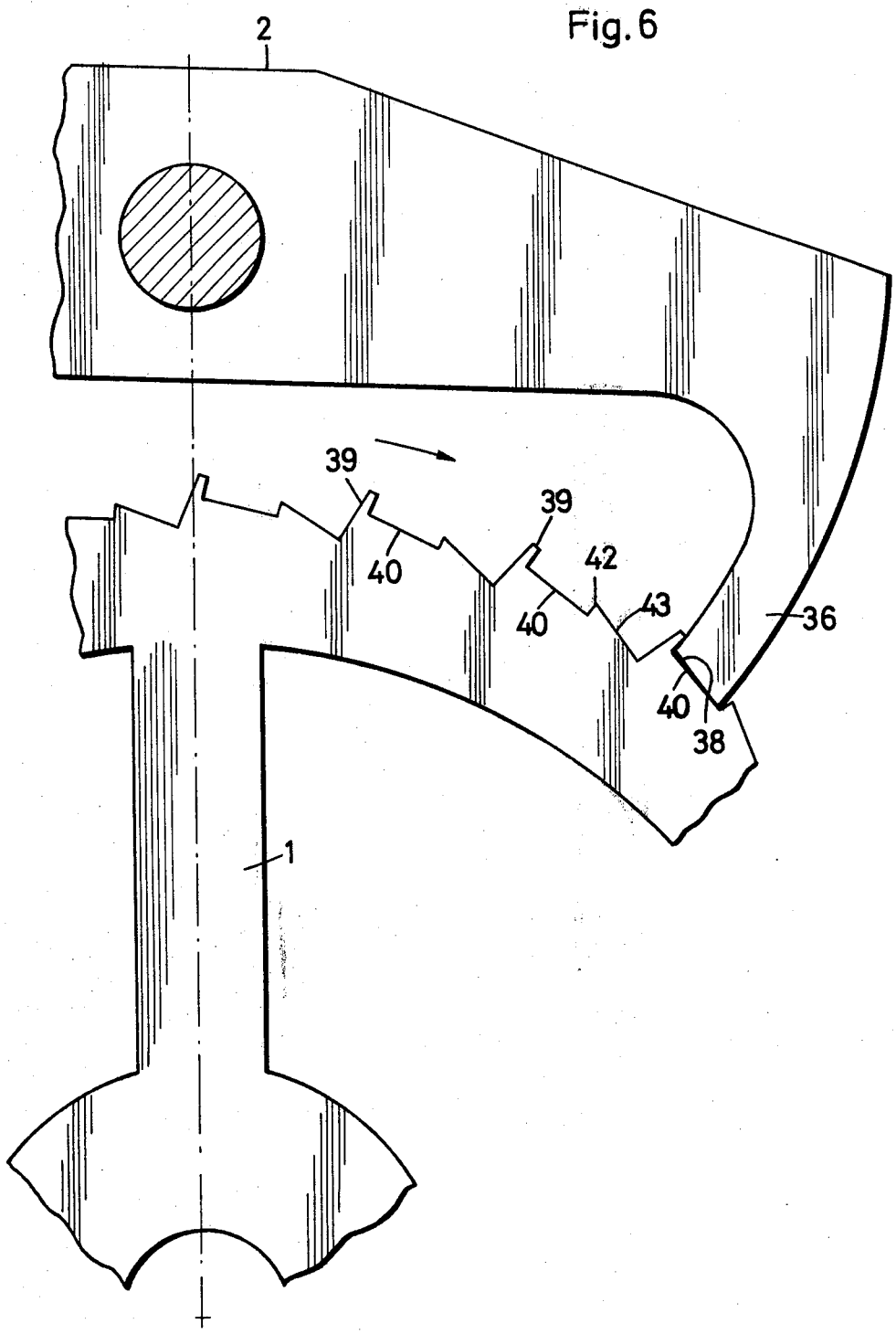
FIG. 6 illustrates the arrangement of FIG. 5, but in its outgoing position.

FIGS. 3 – 6 illustrate a further embodiment of a pendulum clock according to the invention in which the movement gear shaft 11 is easily rotatably journaled in the two plates 15 and 14 and carries a movement wheel 1 which at its circumferential zone comprises a series of particularly designed teeth which are illustrated in FIGS. 5 and 6. The end sections of the two arms of the keeper 2 engage the teeth of the movement wheel 1. The keeper 2 is so journaled on the keeper shaft 3 that, as will be described further below, the keeper is frictionally rotatable relative to the keeper shaft 3. With this embodiment of the invention, the bearing arm 10 is arranged on a hub 29 which is fixedly connected to the keeper shaft 3.

In order to obtain an automatic adjustment of the keeper 2 to the central position with regard to the movement wheel 1, between the keeper shaft 3 and the keeper 2 rotatably arranged thereon there is provided a slip clutch 30. Inasmuch as the slip clutch 30 between the pendulum 9 and the keeper 2 is no longer arranged between the keeper fork 4 and the keeper shaft 3, but between the keeper shaft 3 and the keeper 2, and since the keeper fork 4 is always connected to the keeper shaft 3, the weak pendulum spring 6 is protected against forces which become effective when the keeper fork 4 is not properly treated. The slip clutch 30 comprises a ring 31 fixedly connected to the keeper shaft 3 and also comprises a leg spring 32 which latter presses a friction disc 33, loosely but non-rotatably secured on keeper shaft 3, against the outer surface of the keeper. The oppositely located keeper side surface rests on a second friction disc 34 which is firmly connected to the keeper shaft 3.

For purposes of starting the pendulum clock, the pendulum 9 is deviated beyond its normal oscillation width which it reaches during permanent operation. In this connection, the keeper 2 is by the slip clutch 30 tilted about the keeper shaft 3 to such an extent that one of the two arms 35 and 36 of keeper 2 which are angled off toward the shaft 11 with its lifting surface 37, 38 hits upon the groove bottom between two restraining teeth 39 provided on the circumference of the movement of wheel 1, as illustrated in FIGS. 5 and 6.

Due to the slip clutch 30, the pendulum 9 may also be deviated beyond that angle of deviation which at one of the keeper arms 35, 36, for instance, the keeper arm 35 illustrated in FIG. 5 in its engaging position, hits with its lifting surface 37 upon the movement wheel 1. When the pendulum 9 is relieved, it oscillates to the opposite side approximately at the same amplitude in the opposite direction. In such an instance, in a previously selected sequence, the keeper arm 36 will with its lifting surface 38 on the movement wheel 1 engage the groove bottom 40 between two teeth 39. Also, with this semi-oscillation, the pendulum 9 can swing out to a greater extent than the keeper 2 which due to its abutment is retained on the movement wheel 1, whereas the friction disc 33 and 34 of the clutch 30, which discs are non-rotatably connected to the keeper shaft 3, can continue sliding on the lateral surfaces of the keeper 2 which is now held fast. From that time on at which the pendulum 9, after reaching its maximum operation width, is again reversed and swings back, the slip clutch 30 will be able in view of the friction moment immediately to take along the keeper 2 until it again, in the manner illustrated in FIG. 5, hits upon the groove bottom of the movement wheel 1, but now by one tooth pitch further than during the preceding first manual deviation of the pendulum 9.

Inasmuch as the pendulum 9 from the point of impact of the keeper 2 upon the movement wheel 1 is braked by the sliding friction of the slip clutch 30, finally an oscillation width of the pendulum is established at which the lifting surfaces 37 and 38 just engage the groove bottom 40 of the movement wheel 1, while the braking effect occurring up to that time can no longer occur. The keeper 2 has then adjusted itself relative to the keeper shaft 3 in such a way that the keeper, in conformity with the low dampening of the natural oscillation amplitude of the pendulum 9 carries out approximately symmetrical oscillations relative to the plane 41 extendinng through the axis of the keeper shaft 3 and the axis of the movement wheel shaft 11. This plane 11 need not pass through the center of gravity of the earth. Also in this instance, the movement of the pendulum is not impeded because the pendulum 9 will be able to carry out its oscillation symmetrically with regard to the zero position of the occurring oscillations.

During a complete oscillation of the pendulum 9, the movement wheel 1 moves ahead by one tooth pitch. In the overswing phase, the keeper 2 will, with its inlet and outlet lifting surface 37 and 38, alternatively hit upon the groove bottom 40 of the movement wheel 1. The groove bottom 40 must structurally be so designed that the uneven lifting surfaces 37 and 38 precisely center. According to FIG. 5, the centering area in the groove bottom 40 is located in the vicinity of a restraining tooth 39, and according to FIG. 6 within the vicinity of a groove tooth 42. The groove tooth 32 is necessary in order to absorb the torque which is exerted in opposite direction of movement upon the wheel 1, which latter during the pressure of the lifting surfaces 37 and 38 becomes effective against the centering areas in the groove bottom and in order to prevent a displacement of the centering areas. The centering base section 43 has no functional importance. It must merely be designed so deep that during the ordinary pendulum operation the movement wheel 1 will be able in both directions of rotation to move through in a free manner and only at the restraining teeth 39 pushes against the keeper arms 35 and 36.

The described structural arrangement of the centering system has the particular advantage that no additional movement parts are required. A centering of the keeper could also be realized, if, for instancce, two centering pins are fixedly arranged in the keeper and abut against a disc coaxially rotating with regard to the movement wheel, or abut another adjustable abutment, or if the keeper comprises only one abutment fixedly connected thereto, the movement of oscillation of which is limited on both sides.

The particular advantage of this pendulum clock according to the invention is seen in the fact that in the described manner at a slight inclination of the clock mechanism relative to the vertical plane, the central plane 41 is automatically adjusted as the plane of symmetry for the oscillations of the keeper, because the keeper 2, due to the friction clutch 30, will automatically adjust itself to the keeper shaft 3 to such an extent that the pendulum 9 can likewise carry out symmetrical oscillations.

It is, of course, to be understood that the present invention is, by no means, limited to the specific showing in the drawings, but also comprises any modifications within the scope of the appended claims.

What we claim is:

1. A pendulum clock which includes in combination: a pendulum having an upper end section, a pendulum extension having an upper end portion and a lower end portion, said lower end portion being connected to said upper end section of said pendulum, a carrier member, pendulum spring means supported by said carrier member and supporting said upper end portion of said pendulum extension, a keeper fork including a protective rigid connecting member with a fork-shaped portion having fork prongs thereof straddle said pendulum extension suspended below said pendulum spring means automatically to assure swinging oscillation in a common plane for said carrier member and said pendulum extension, and a keeper shaft operatively connected to said keeper fork, said keeper fork and said protective rigid connecting member with said fork-shaped portion consisting of a single integral piece that takes up turning forces upon said pendulum spring means.

2. A pendulum clock in combination according to claim 1, which includes a keeper provided with lifting surfaces and operatively connected to said upper shaft, a movement wheel cooperating with said keeper and having tooth means with tooth spaces for cooperating with said lifting surfaces of said keeper, said lifting surfaces and said tooth spaces being centered relative to each other for automatically centering said keeper during the adjusting phase of said pendulum, and means establishing frictional connection between said keeper and said pendulum.

3. A pendulum clock in combination according to claim 2, which includes friction clutch means for establishing frictional connection between said keeper and said keeper shaft.

4. A pendulum clock in combination according to claim 3 in which said keeper is radially mounted with play on said keeper shaft, and in which said friction clutch includes a first friction disc axially displaceably but non-rotatably mounted on said keeper shaft on one side of said keeper, and also includes a second friction disc rigidly connected to said keeper shaft and arranged on the other side of and adjacent to said keeper, and leg spring means operable through said first friction disc to press said keeper against said second friction disc.

5. A pendulum clock in combination according to claim 2, in which said tooth means of said movement wheel comprise alternately succeeding restraining teeth and groove teeth with each restraining tooth followed by a groove tooth, the centering area on the groove bottom of the movement wheel being located adjacent a restraining tooth and adjacent a groove tooth.

6. A pendulum clock in combination according to claim 5, in which the tooth space bottom section is so deep that the movement wheel during the normal pendulum movement can move freely in both directions of oscillation and only in said restraining teeth abuts said keeper.

* * * * *